US008216059B2

(12) United States Patent
Prasad et al.

(10) Patent No.: US 8,216,059 B2
(45) Date of Patent: Jul. 10, 2012

(54) METHOD FOR SECURELY EXCHANGING PROMOTIONAL TICKET RELATED INFORMATION

(75) Inventors: Bhavani Prasad, Reno, NV (US); Marc Espin, Sparks, NV (US)

(73) Assignee: IGT, Reno, NV (US)

( * ) Notice: Subject to any disclaimer, the term of this patent is extended or adjusted under 35 U.S.C. 154(b) by 1643 days.

(21) Appl. No.: 10/981,329

(22) Filed: Nov. 3, 2004

(65) Prior Publication Data

US 2005/0096126 A1 May 5, 2005

Related U.S. Application Data

(63) Continuation-in-part of application No. 09/688,775, filed on Oct. 16, 2000, now Pat. No. 6,892,182.

(51) Int. Cl.
*A63F 9/24* (2006.01)

(52) U.S. Cl. ..... 463/25

(58) Field of Classification Search ..... 463/20, 463/17, 25, 29

See application file for complete search history.

(56) References Cited

U.S. PATENT DOCUMENTS

| | | | | |
|---|---|---|---|---|
| 5,237,165 | A | 8/1993 | Novak | |
| 5,317,135 | A * | 5/1994 | Finocchio | 463/17 |
| 5,429,361 | A * | 7/1995 | Raven et al. | 463/25 |
| 5,470,079 | A | 11/1995 | LeStrange et al. | |
| 5,628,684 | A * | 5/1997 | Bouedec | 463/17 |
| 5,643,086 | A | 7/1997 | Alcorn et al. | 463/29 |
| 5,928,082 | A | 7/1999 | Clapper, Jr. | 463/16 |
| 5,967,892 | A | 10/1999 | Shoemaker, Jr. | 463/7 |
| 6,012,832 | A | 1/2000 | Saunders et al. | 364/410 |
| 6,018,717 | A | 1/2000 | Lee et al. | 705/13 |
| 6,048,269 | A | 4/2000 | Burns et al. | 463/25 |
| 6,117,011 | A | 9/2000 | Lvov | 463/25 |
| 6,193,608 | B1 * | 2/2001 | Walker et al. | 463/25 |
| 6,203,011 | B1 * | 3/2001 | Nulph | 273/138.2 |
| 6,203,427 | B1 | 3/2001 | Walker et al. | 463/16 |
| 6,558,256 | B1 | 5/2003 | Saunders | |
| 6,675,152 | B1 | 1/2004 | Prasad et al. | 705/64 |
| 6,682,421 | B1 | 1/2004 | Rowe et al. | 463/25 |
| 6,842,898 | B1 * | 1/2005 | Carlson et al. | 718/100 |
| 6,892,182 | B1 | 5/2005 | Rowe et al. | |
| 7,486,628 | B1 * | 2/2009 | Brisebois et al. | 370/260 |

(Continued)

FOREIGN PATENT DOCUMENTS

GB 2 387 261 A 10/2003

(Continued)

OTHER PUBLICATIONS

U.S. Appl. No. 09/688,775 entitled "Method and Apparatus for Ticket Generation and Accounting", by inventors Rowe et al., filed Oct. 16, 2000.

(Continued)

*Primary Examiner* — Omkar Deodhar

(74) *Attorney, Agent, or Firm* — Weaver Austin Villeneuve & Sampson LLP

(57) ABSTRACT

The present invention provides gaming machine systems and methods that enable outsourced printing and generation of printed credit devices for use with a gaming machine. The systems verify the print status of an externally printed credit device before redeeming any value on the credit device at a gaming machine. The ability to employ outsourced gaming printing services providers increases the number and sophistication of printed credit devices that may be manufactured and distributed to potential customers.

27 Claims, 8 Drawing Sheets

U.S. PATENT DOCUMENTS

| | | | | |
|---|---|---|---|---|
| 2002/0045477 | A1 | 4/2002 | Dabrowski | |
| 2002/0142825 | A1 | 10/2002 | Lark et al. | |
| 2004/0095604 | A1 | 5/2004 | Meyerhofer | 358/1.18 |
| 2004/0171421 | A1 | 9/2004 | Saunders | |
| 2004/0176158 | A1* | 9/2004 | Baldwin | 463/17 |
| 2005/0075157 | A1 | 4/2005 | Seelig et al. | |

FOREIGN PATENT DOCUMENTS

| | | | |
|---|---|---|---|
| JP | 411253609 | A | 9/1999 |
| WO | WO 94/16781 | | 8/1994 |
| WO | WO 02/32520 | | 4/2002 |
| WO | WO 2006/052469 | A2 | 5/2006 |

OTHER PUBLICATIONS

International Search Report and Written Opinion for corresponding PCT Patent Application No. PCT/US2005/038798 dated May 11, 2006.

Examination Report dated Jun. 22, 2010 for Australian Patent Application No. 2005305158.

U.S. Office Action dated Oct. 2, 2002 issued in U.S. Appl. No. 09/688,775.

U.S. Office Action Final dated Mar. 24, 2003 issued in U.S. Appl. No. 09/688,775.

U.S. Office Action dated Jul. 14, 2003 issued in U.S. Appl. No. 09/688,775.

U.S. Office Action dated Dec. 23, 2003 issued in U.S. Appl. No. 09/688,775.

U.S. Notice of Allowance dated Dec. 17, 2004 issued in U.S. Appl. No. 09/688,775.

PCT International Search Report dated Jan. 2, 2002 issued in PCT/US2001/31764.

PCT International Preliminary Examination Report dated Sep. 12, 2002 issued in PCT/US2001/31764.

AU Examiner's first report dated Jan. 17, 2006 issued in AU 2002211627.

CA Office Action dated May 3, 2006 issued in CA 2,425,896.

European Supplementary Search Report dated Nov. 6, 2008 issued in EP 01 97 9693.

AU Examiner's Report No. 2 dated May 12, 2011 issued in Australian Patent Application No. 2005305158.

* cited by examiner

500

| 502 Credit device Number (Primary Key) | 504 Print Status | 506 Value | 508 Redemption Status | 510 Date req.? | 512 Machine Number Req.? |
|---|---|---|---|---|---|
| 010001 | not printed | $5 | unused | none | 0050 - 0060 |
| 010002 | not printed | $5 | unsuccessful | 01/01/05-01/07/05 | none |
| 010003 | printed | $20 | redeemed | none | none |
| 010004 | printed | $20 | redeemed | 12/2/04-12/6/04 | 0010-0060 |
| 010005 | printed | 5 free plays on game X | unused | none | 0010-0060 |

501

*FIG. 4*

METHOD FOR SECURELY EXCHANGING PROMOTIONAL TICKET RELATED INFORMATION

CROSS-REFERENCE TO RELATED APPLICATION

This application is a continuation-in-part of U.S. Patent Application entitled "Method and Apparatus for Ticket Generation and Accounting" by Rowe et al., filed on Oct. 16, 2000 (U.S. application Ser. No. 09/688,775), now U.S. Pat. No. 6,892,182 which is herein incorporated by reference herein for all purposes.

FIELD OF THE INVENTION

This invention relates to gaming machine systems. More particularly, the present invention relates to printed credit devices used on gaming machines, such as printed paper tickets or printed plastic cards.

Gaming machines are becoming increasingly sophisticated. Gambling machines that include a computer processor, LCD display and related computer peripheral devices are now the norm in place of older mechanically-driven reel displays. Many casinos employ networks of electronically linked gaming machines. Each gaming machine may offer a different game stored as software in memory included with the gaming machine.

Some casinos now employ bar-coded tickets. When a player terminates interaction on a gaming machine, a small printer included in the gaming machine prints a black and white ticket that indicates the player's final status and cash-out value. The player may redeem the ticket for game credit at another machine or cash it at a change booth.

As will be appreciated, it is important to ensure the authenticity of a ticket before it is paid. Printing paper tickets is thus currently limited to printing in a casino at a trusted source such as a gaming machine or cashier station, neither of which is intended for bulk or advanced printing.

From the foregoing, it should be apparent that gaming establishments are still limited in what transaction currency services they are able to provide.

SUMMARY OF THE INVENTION

The present invention provides gaming machine systems and methods that enable outsourced printing and generation of printed credit devices for use with a gaming machine. The systems verify the print status of an externally printed credit device before redeeming any value on the credit device at a gaming machine. The ability to employ outsourced gaming printing services providers increases the number and sophistication of printed credit devices that may be manufactured and distributed to potential customers.

In one aspect, the present invention relates to a gaming system that redeems a printed credit device that was printed by a printing services provider. The gaming system comprises at least one gaming machine. The gaming machine includes an external cabinet defining an interior region of the gaming machine. The external cabinet is adapted to house a plurality of gaming machine components. The gaming machine also includes a display device adapted to display game play information. The display device is located within or about the external cabinet. The gaming machine further includes a scanner configured to read information from the printed credit device when the printed credit device is provided to the scanner. The scanner is located within or about the external cabinet. The gaming system also comprises a host that comprises a processing system configured to a) store information regarding the printed credit device, b) verify that a print confirmation has been received from the printing services provider and c) permit value on the printed credit device to be redeemed at the gaming machine after the print confirmation has been received. The gaming system additionally comprises a communication link permitting information to be transmitted between the at least one gaming machine and the host.

In another aspect, the present invention relates to a gaming machine that redeems a printed credit device that was printed by a printing services provider. The gaming machine comprises an external cabinet defining an interior region of the gaming machine. The external cabinet is adapted to house a plurality of gaming machine components within or about the interior region. The gaming machine also includes a display device adapted to display game play information. The display device is located within or about the external cabinet. The gaming machine further includes a scanner configured to read information from the credit device when the printed credit device is provided to the scanner. The scanner is located within or about the external cabinet. The gaming machine also comprises a processing system configured to a) store information regarding the printed credit device, b) verify that a print confirmation has been received from the printing services provider and c) permit value on the printed credit device to be redeemed at the gaming machine after the print confirmation has been received. The gaming machine further comprises a network interface that allows the gaming machine to communicate with the printing services provider.

In another aspect, the present invention relates to a method for providing a printed credit device service for players of a gaming machine. The method comprises creating a credit device record that comprises a list of credit devices to be printed. The method also comprises sending the credit device record to a printing services provider. The method further comprises receiving a print confirmation from the printing services provider that indicates that the credit devices have been printed. The method additionally comprises updating an electronic record for each credit device to note that the print confirmation has been received. The method also comprises redeeming value on a printed credit device included in the list of credit devices at a gaming machine after verifying that the print confirmation has been received for the printed credit device.

These and other features and advantages of the invention will be described in more detail below with reference to the associated figures.

BRIEF DESCRIPTION OF THE DRAWINGS

The present invention is illustrated by way of example, and not by way of limitation, in the figures of the accompanying drawings and in which like reference numerals refer to similar elements and in which:

FIG. 4 presents a logical representation of a database for storing information related to a large number of credit devices with a print status in accordance with a specific embodiment of this invention.

DESCRIPTION OF THE PREFERRED EMBODIMENTS

Figure 1A:
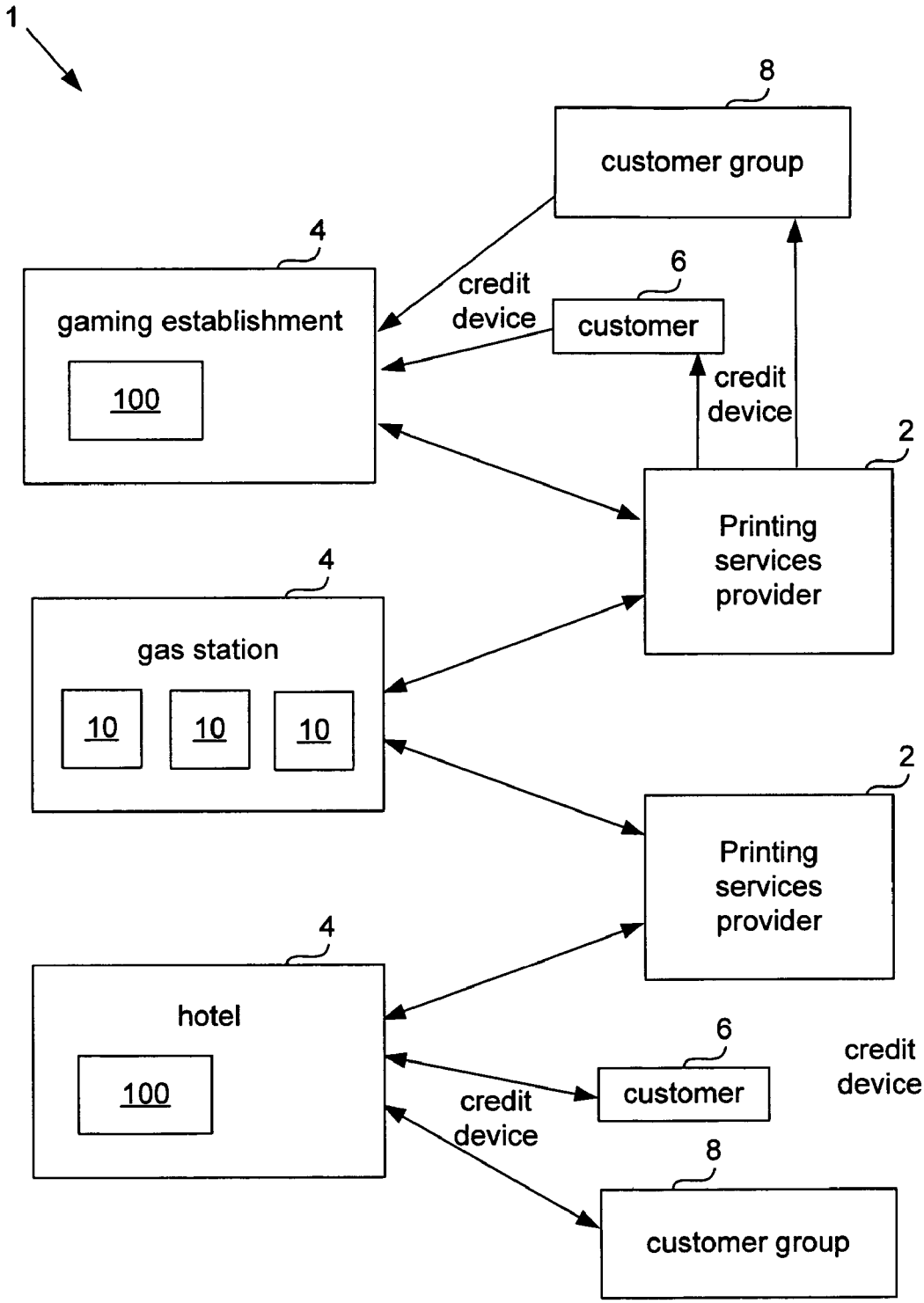
FIG. 1A shows an illustrative printing services and gaming establishment arrangement in accordance with one embodiment of the present invention.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

This invention provides gaming machine systems that allow outsourced printing and generation of credit devices for use with gaming machines. The ability to employ an outsourced printing service provider increases printing capacity when manufacturing a large number of credit devices, permits greater printing quality and sophistication, and increases flexibility for business implementation of credit devices.

While the present invention allows a non-casino entity to print credit devices such as paper tickets, allowing non-casino entities to print a credit device that has cash or playing value in a casino opens the door for misuse and unscrupulous behavior. To defend from exploitation, the present invention checks validity of a credit device before redeeming any value. For example, a processing system included in a gaming machine, or included in a separate computer that communicates with the gaming machine, may verify whether the printing services provider has confirmed printing of the credit device before redeeming any value on the credit device at the gaming machine.

One or more conditional usage requirements may also be applied to the credit device, such as limiting credit device usage and redemption to a certain time of day. Alternatively, the credit device may be restricted to play on a certain game or machine, e.g., that a casino wants to promote or increase usage of. The conditional usage requirements may be printed on the credit device for user awareness. In addition, a processing system that determines whether the ticket is valid may access a database that includes an entry for the ticket that informs the processing system of any conditional usage requirements on the ticket. The processing system may then verify that the conditional usage requirements are met before redeeming value on the ticket (e.g., is the ticket being used in its intended date range if one has been applied?).

A printed credit device as described herein generally refers to any credit device suitable for interaction with a gaming machine that includes some form of printing thereon. The term 'credit device' may be used interchangeably herein with the term 'voucher'. Exemplary credit devices include printed paper tickets and printed plastic cards. A paper ticket may comprise any card stock or gloss covering as determined by a desired quality for the ticket and/or by a scanner included in a gaming machine that receives the ticket. Printing on plastic cards is becoming increasingly popular, less expensive and is suitable for use with the present invention.

The printing may range from simple black-and-white copying to advanced graphics that employs pictures and/or colors. The advanced graphics may be tailored to a specific gaming establishment such as a casino and include graphics associated with the casino such as its logo or a color picture of the casino. The paper ticket or plastic card may include printing on one surface or both opposite surfaces. For example, one surface of a plastic card may include a bar code for reading by a scanner included in a gaming machine while the other side includes a picture of the casino that honors the card.

Information stored on the credit device for detection by an optical scanner may be stored using a barcode system, alphanumeric numbers and English letters that may or may not be coded, or any suitable optical information storage system. Presenting the visual information in an uncoded manner using alphanumeric numbers and English letters also allows a person holding the credit device to read the visual information.

The present invention may also employ plastic cards that include a magnetic strip that stores information. Some casinos issue player identification or player tracking cards that furnish a person awards for frequent patronage. Before beginning play, a player presents the card to a magnetic card reader that communicates with the gaming machine. The reader detects the card, and software on the gaming machine or network notes the player identity and verifies card value. For the present invention, a credit device comprising a magnetic strip includes printing provided by a printing services provider, such as printing on a card surface opposite to the magnetic strip that designates a particular casino or game that the card is valid for (e.g., Video Poker or Pachinko).

The credit device is often portable. A person may carry the portable credit device until redemption at a gaming machine. Many portable printed tickets and plastic cards are also well-suited for mailing. This aids businesses such as casinos in promotional efforts that mail promotional packages and credit devices to a large number of people.

While the present invention will now primarily be discussed with respect to printed paper tickets, it is understood that credit devices as described herein may comprise any credit device suitable for use with a gaming machine and that includes printing thereon provided by a printing services provider.

FIG. 1A shows an illustrative printing services and gaming establishment arrangement 1 in accordance with one embodiment of the present invention. Arrangement 1 comprises printing service providers 2, gaming establishments 4, customers 6 and customer groups 8.

Each gaming establishment 4 comprises a gaming system 100 that includes at least one gaming machine. As the term is used herein, gaming establishment 4 refers to any business or organization that operates at least one gaming machine on its premises and/or offers gaming machine services to potential customers. Exemplary establishments that currently operate gaming machines on their premises include casinos, hotels, airports, restaurants, nightclubs, grocery stores, gas stations and convenience stores. One gaming system 100 suitable for use by a casino is described in further detail with respect to FIG. 1B. The gaming machine services provider may includes a gaming machine manufacturer or a business that offers gaming machine services (such as progressive pools or financial services for ticket redemption) to a casino.

Printing services provider 2 at least partially prints credit devices for use on a gaming machine 10. Printing services provider 2 may comprise any service or business that includes or offers printing capability. Many printing services providers 2 include dedicated printing facilities that offer the ability to mass-produce printed paper products or generate custom printings. Typically, provider 2 has access to printing technology and production capability that enables a large number of tickets to be manufactured. While mass printing of tickets with multiple machines is desirable in many cases, such bulk manufacture is not necessarily a requirement and provider 2 may include a single printer.

The ability for printing services provider 2 to generate custom printings allows an individual gaming establishment (such as a casino) to print a custom batch of credit devices. For example, a casino may have an outsourced printer manufacture 10,000 or more tickets, each having a color image that resembles the casino and a print quality corresponding to a desired market image for the casino. Advanced graphics and colors may thus be implemented in the printing to increase attractiveness of a paper ticket or plastic card, as desired by the gaming establishment. Printing may comprise any suitable technology for the medium being printed upon. For example, printing on paper tickets may comprise inkjet or laser printing. Printing on plastic cards may comprise silk-screen printing for example.

Printing services provider 2 may also provide mailing services for the casino. In this case, provider 2 prints a large number of tickets for distribution to a set of customers, packages the tickets for mailing (e.g., in a sales brochure or flyer), and mails the tickets to the customers. This enables the gaming establishment 4 to employ outsourced services in promotional efforts that include offering potential customers free and valid game credit. Printing services provider 2 need not be geographically external to the gaming establishment. A large casino may include its own printing services provider 2. In this case, the printing is not outsourced to a separate business entity. Security provisions in accordance with the present invention are still implemented in these instances to protect integrity of a gaming system.

The printing services provider 2 may either send printed credit devices back to the gaming establishment 4 for distribution and/or send them directly to one more potential customers 6 or customer groups 8. Customer group 8 refers to a set of people collectively designated by a gaming establishment. For example, customer group 8 may refer to participants at a convention that is being held at a hotel 4 who owns and operates gaming machines. Alternatively, customer group 8 may refer to frequent players of a specific game operated on a gaming machine, such as Video Poker.

When presented to a properly configured gaming machine 10 or gaming system 100, the printed credit devices may be redeemed for game credits that allow a person to play a game on a gaming machine. Redemption may depend on a number of conditions. Conditions placed on to credit device usage may include, for example, a time period of day in which the credit device is to be used, a select set of machines within the casino that honor the credit device, a date range in which the credit device is valid, etc. An exemplary credit device in the form of a paper ticket 200 is described below with respect to FIG. 2.

The printed credit device may thus be used as an attraction for a customer 6 or person in the customer group 8 to attend a gaming establishment 4 and play a game. For example, a printed paper ticket may offer a player $20 of game credit and limited free play on gaming machines at a particular casino. Typically, a customer presents the credit device into a scanner included in the gaming machine. The scanner then reads (optically, magnetically, etc.) information stored on the credit device. A processing system on the gaming machine then performs one or more verifications on the print status of the credit device and/or any conditional usage requirements. If the verifications pass, the gaming machine redeems any value for the credit device.

Permitting an outsourced printing services provider 2 to print credit devices increases service options for a gaming establishment. For example, mass-production enables new promotional business opportunities for a casino. The casino may order promotional tickets to be printed and mailed to a large group of people of particular interest. One promotional business example relates to people who attend conventions, which are very popular in cities such as Las Vegas and Atlantic City. Each year, hundreds of conventions such as computer conventions, technology conventions, industry conventions and the like are held in each of these two cities. The present invention enables a casino to mass-produce and provide (mail directly to, include in registration packages, etc.) paper tickets with game credit to each person attending a convention. This both increases attractiveness of the convention to the attendee—and increases draw to the casino for people already coming to their city.

One or more conditional usage requirements may also be placed on a credit device. A conditional usage requirement protects the gaming establishment's intent for ticket usage. For example, a date range for usage corresponding to a convention date may be printed on a credit device and applied by a gaming system. In this case, gaming system 100 includes a processing system configured to check if there any conditional usage requirements placed on the credit device when a credit device is received in a gaming machine 10. For the date example, the processing system checks the date the ticket is presented to a gaming machine. If the usage date falls within the acceptable date range applied to the credit device, any value on the credit device is redeemed at the gaming machine 10. Unacceptable credit devices may be collected by the gaming machine or returned to the user as unacceptable. In this manner, a conditional usage requirement protects the gaming establishment's intended use for the credit device and defends from unscrupulous individuals who, for example, collect tickets from numerous conventions and try to redeem them weeks later.

In one embodiment, the credit devices are only redeemable for game credit at a gaming machine 10. This in contrast to other approaches where a gaming establishment provides vouchers (to induce game play and promote casino patronage) that are worth money and redeemable at a cashier's cage—without playing a game. Some customers abuse this system: they receive a voucher (or collect multiple vouchers), redeem it in at a cashier's cage for cash, and then leave the casino. The present invention however protects a casino from such abuse and forces a customer to play a game on a gaming machine if they want to redeem value in the credit device.

Figure 1B:
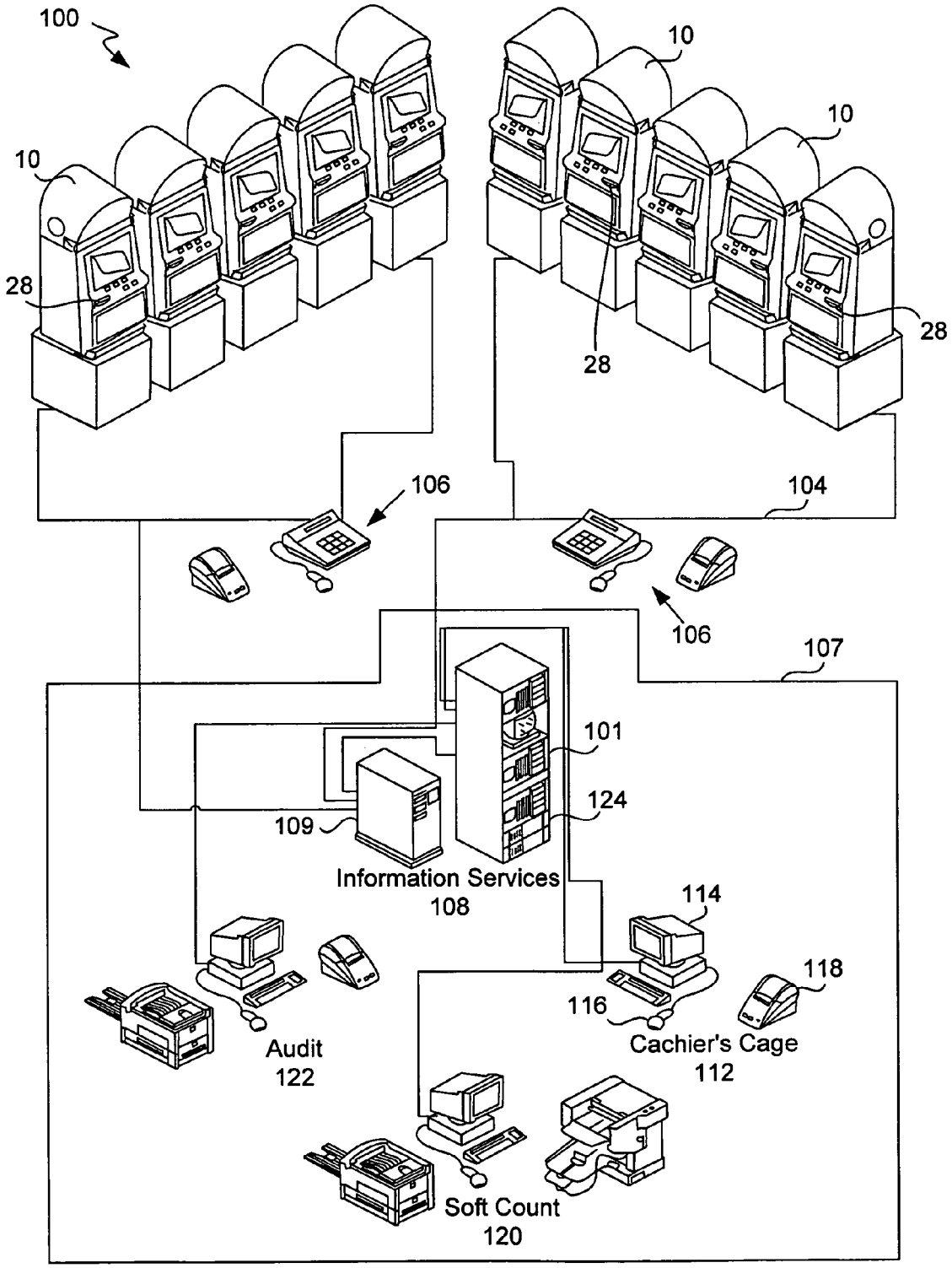
FIG. 1B is a schematic diagram of a gaming machine network that redeems a credit device printed by a printing services provider in accordance with one embodiment of the present invention.

FIG. 1B is a schematic diagram of a gaming machine network 100 that redeems a printed credit device printed by a printing services provider in accordance with one embodiment of the present invention. Network 100 includes a set of gaming machines 10. Each gaming machine 10 permits a valid printed credit device as a form of credit to begin a transaction between a player and a gaming machine 10. Upon completion of a transaction with a gaming machine 10, the player may be issued money or a new credit device. The gaming machine itself may issue the new credit device.

Gaming machine 10 comprises a scanner 28 that reads information from the credit device when the credit device is provided to the scanner. In one embodiment, scanner 28 comprises optical scanning technology known to those of skill in the art that is configured to read a bar code or other visual information printed on a paper ticket or plastic card. The scanner may be included in a bill scanner, bill validator or a similar device configured to read printed information on a paper or plastic credit device. If a bar code is used, the bar code is typically printed on the credit device in a known location that corresponds to where the scanning technology expects to read the bar code when the credit device is presented to the scanner. In another embodiment, the credit device comprises a magnetic strip and scanner 28 includes magnetic scanning technology that reads information contained in the magnetic strip. Gaming machine 10 will be described in further detail below.

One or more gaming machines 10 may be associated with a host that comprises a processing system configured to a) store information regarding multiple printed credit devices, b) verify that a print confirmation has been received from the printing services provider 2, and c) permit value on a printed credit device to be redeemed at a gaming machine 10 after the print confirmation has been received for that credit device. As the term is used herein, a host refers to any computer a processing system that transmits information with the gaming machine 10 across a communication link 104. The host may comprise a single computer or a group of computers associated with one another on a network. System 100 may include several entities that operate as a host: information services 108, Clerk Validation Terminal 106, a computer at cashier's cage 112, a computer at audit station 122 and/or a computer at soft count station 120.

In some embodiments, numerous machines 10 connect to a single cluster controller or a Clerk Validation Terminal (CVT) 106. In one embodiment, a single CVT 106 may accommodate up to 64 machines. A gaming machine 10 that communicates with CVT 106 will accept credit devices from other gaming machines 10 connected to the same CVT 106. The CVT 106 may also contain memory for retaining credit device information. This may be used as a secondary storage medium for credit device information recovery in the event of power failure or memory loss to the main memory in the network 100.

As there may be many groups of gaming machines 10 in a large casino or other establishment, multiple CVTs 106 may be implemented. The CVTs 106 are connected to a local area network (LAN) 107 which includes a number of computers or workstations as well as terminals, disk drives with fixed and/or removable media, printers and other peripherals. The computers on the LAN 107 may provide the casino with various functions such as processing jackpots and fills, exporting of transaction information to the central accounting system, and generating accounting reports and security reports, etc. Other components connected to LAN 107 may include multiplexers, modems, and phone lines to an external system or network.

Some casinos connect multiple local area networks to wide area networks spanning multiple casinos. Such wide area networks allow groups of slot machines at various casinos to be connected to one another for various purposes including use in "progressive" games. Progressive games allow jackpots from multiple machines in multiple locations to grow as one large jackpot.

LAN 107 also includes information services 108. Each gaming machine 10 and CVT 106 communicates with information services 108 via LAN 107. Information services 108 includes a processing system 101 that is configured to a) verify that a confirmation has been received from the external printing services provider 2 and b) permit value on a ticket to be redeemed at a gaming machine 10 after the confirmation has been received. Processing system 101 may comprise any suitable combination of hardware and/or software for carrying out these and other gaming machine related functions. One suitable processing system 101 will be described below with respect to FIG. 5. Some form of memory is typically included within processing system 101. The memory stores information regarding the printed credit devices. More specifically, the memory stores printing services provider confirmation information and any conditional usage requirement information for tickets used on gaming machines 10. In a specific embodiment, processing system 101 stores a database that includes a print confirmation and conditional usage requirements for each ticket that awaits redemption, or that has already redeemed, on a gaming machine 10. An exemplary database containing entries suitable for such access is described below with respect to FIG. 4.

Information services 108 also includes a front end controller 109 that acts as a general controller for network 100. Controller 109 may continuously poll the various CVTs 106 and request information pertaining to gaming transactions in the network 100. The CVTs 106, in turn, continuously poll machines 10. For example, if a ticket has been inserted in a gaming machine 10, that machine will communicate an insertion event to its CVT 106 in response to the next CVT 106 poll. Then when the front end controller 109 polls the CVT 106, the CVT 106 communicates the insertion event to the front end controller 109.

LAN 107 includes various additional stations. A cashier's station 112 is included for redemption of credit devices created within the network 100. Cashier's station 112 includes a computer 114 with a printer 118 and an optical scanner 116, such as a bar code scanner, for reading credit devices. Network 100 may accommodate as many cashier stations 112 as required to support a facility.

Additional stations may be included in the LAN 107. For example, the LAN 107 and may include a station in charge of security and a workstation in charge of surveillance. A soft count station 120 may also be included for daily verification of bills and tickets accepted gaming machines 10 in the network 100. An audit station 122 may also be included for accounting purposes. Any of the stations in the LAN 107 may include a processing system as described below with respect to FIG. 4A. Each of the stations on LAN 107, including the front end controller 109, may be implemented on any of a variety of commercially available computer systems. Such machines include, but are not limited to, PC compatibles, DEC VAXs, and UNIX machines. In alternative embodiments, the various network functions such as front end control are accomplished by distributed processing. In such cases, the network functions are performed on multiple nodes.

In the depicted example, information services 108 also includes a file server 124 which is the main processor in the network. A suitable file server machine is the Compaq 550 available from Compaq Computers. The file server communicates with all stations included on the LAN 107. The file server communicates with an external host, such as a computer configured for external communication that is operated or used by an outsourced printing services provider 12, located on an external network through a modem or another suitable Internet communication interface.

Network 100 electronically transfers printing services provider confirmation and conditional usage requirement information between a central processing system 101 and each gaming machine 10. For this purpose, network 100 includes one or communication links. A communication link may employ lines or cables 104, which may take various forms including coaxial wires, wireless connections or fiber optic cable, as one of skill in the art will appreciate.

Although gaming system 100 includes a modular system suitable for use in a large gaming establishment such as a casino, it is understood that gaming systems of the present invention need not comprise such complexity. In some cases, gaming system 100 comprises a few gaming machines 10 where each gaming machine includes a processing system configured to a) verify that a confirmation has been received from the external printing services provider 2 and b) permit value on a printed credit device to be redeemed at the gaming machine after the confirmation has been received. Systems 100 that include between about 1 and about 10 gaming machines are common in establishments such as grocery stores, gas stations and convenience stores for example.

Figure 1C:
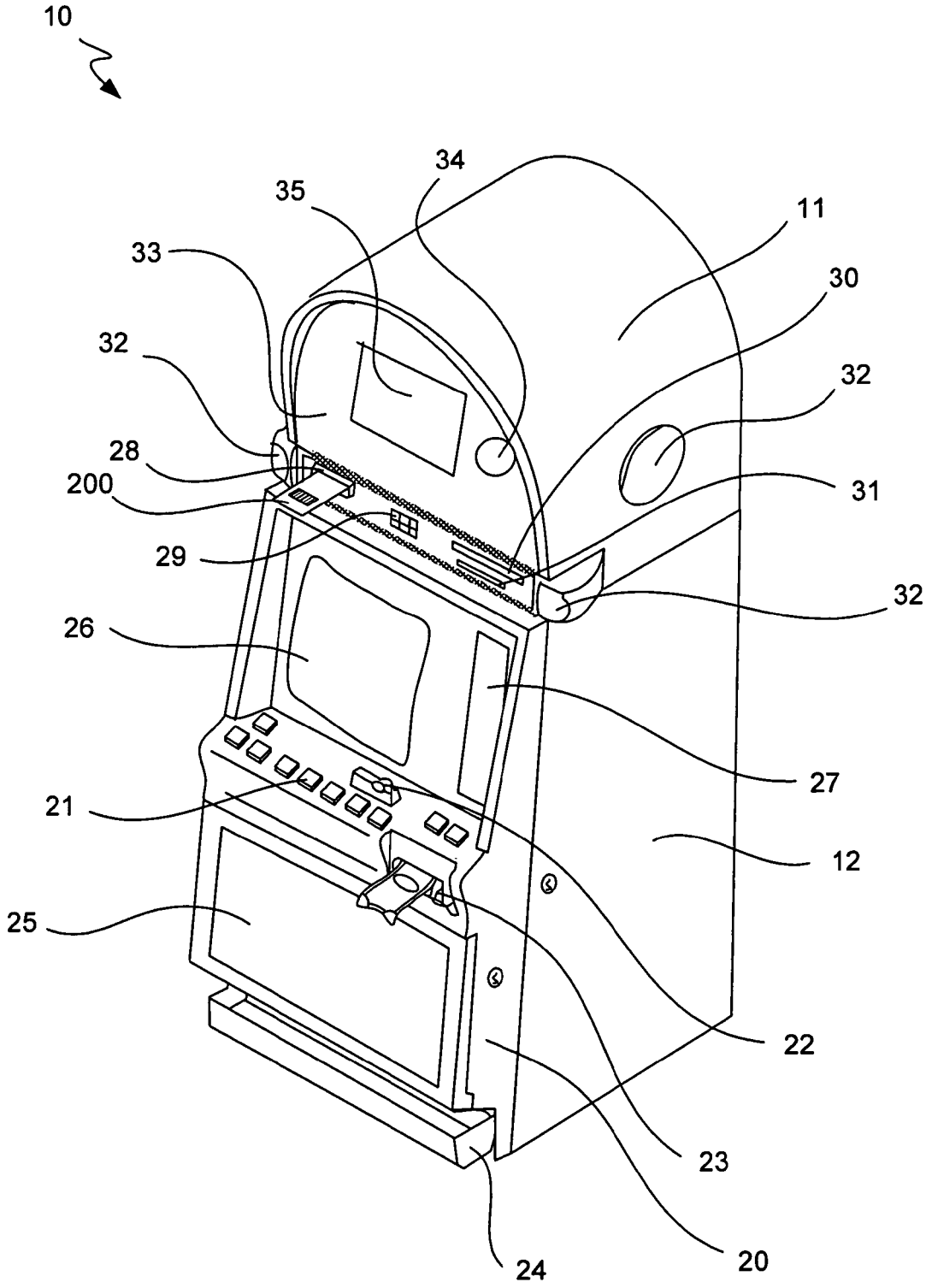
FIG. 1C illustrates an exemplary gaming machine in perspective view according to one embodiment of the present invention.

Turning briefly to FIG. 1C, an exemplary gaming machine for use according to one embodiment of the present invention is illustrated in perspective view. Gaming machine 10 includes a top box 11 and a main cabinet 12, which generally surrounds the machine interior and is viewable by users. Main cabinet 12 includes a main door 20 on the front of the machine, which opens to provide access to the interior of the machine. Attached to the main door are typically one or more player-input switches or buttons 21, one or more money or credit acceptors, such as a coin acceptor 22, and a bill or ticket scanner 23, a coin tray 24, and a belly glass 25. Viewable through main door 20 is a primary video display monitor 26 and one or more information panels 27. In one embodiment, the scanner 23 is included in a scanning device adapted to receive the credit device and dispense coins and/or currency. In a specific embodiment, the scanning device comprises a Cassomat Casino Royal Model RC F3 manufactured by Perconta of Germany. The primary video display monitor 26 will typically be a cathode ray tube, high resolution flat-panel LCD, plasma/LED display or other conventional electronically controlled video monitor. Top box 11, which typically rests atop of the main cabinet 12, may also contain a ticket printer 28, a key pad 29, one or more additional displays 30, a card reader 31, one or more speakers 32, a top glass 33, one or more cameras 34, and one or more secondary video display monitors 35, which may also be a cathode ray tube, high resolution flat-panel LCD, plasma/LED display or other conventional electronically controlled video monitors. Other components and combinations are also possible, as is the ability of the top box to contain one or more items traditionally reserved for main cabinet locations, and vice versa.

It will be readily understood that gaming machine 10 can be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. While gaming machine 10 is usually adapted for live game play with a physically present player, it is also contemplated that such a gaming machine may also be adapted for remote game play with a player at a remote gaming terminal. Such an adaptation preferably involves communication from the gaming machine to at least one outside location, such as a remote gaming terminal itself, as well as the incorporation of a gaming network that is capable of supporting a system of remote gaming with multiple gaming machines and/or multiple remote gaming terminals.

Gaming machine 10 may also be a "dummy" machine, kiosk or gaming terminal, in that all processing may be done at a remote server, with only the external housing, displays, and pertinent inputs and outputs being available to a player. Further, it is also worth noting that the term "gaming machine" may also refer to a wide variety of gaming devices in addition to traditional free standing gaming machines such as that shown in FIG. 1. Such other gaming machines can include kiosks, set-top boxes for use with televisions in hotel rooms and elsewhere, and many server based systems that permit players to log in and play remotely, such as at a personal computer or PDA. All such gaming devices can be considered "gaming machines" for purposes of the present invention and following discussion, with all of the disclosed metering techniques and devices being adaptable for such uses of alternative gaming machines and devices.

Figure 1D:
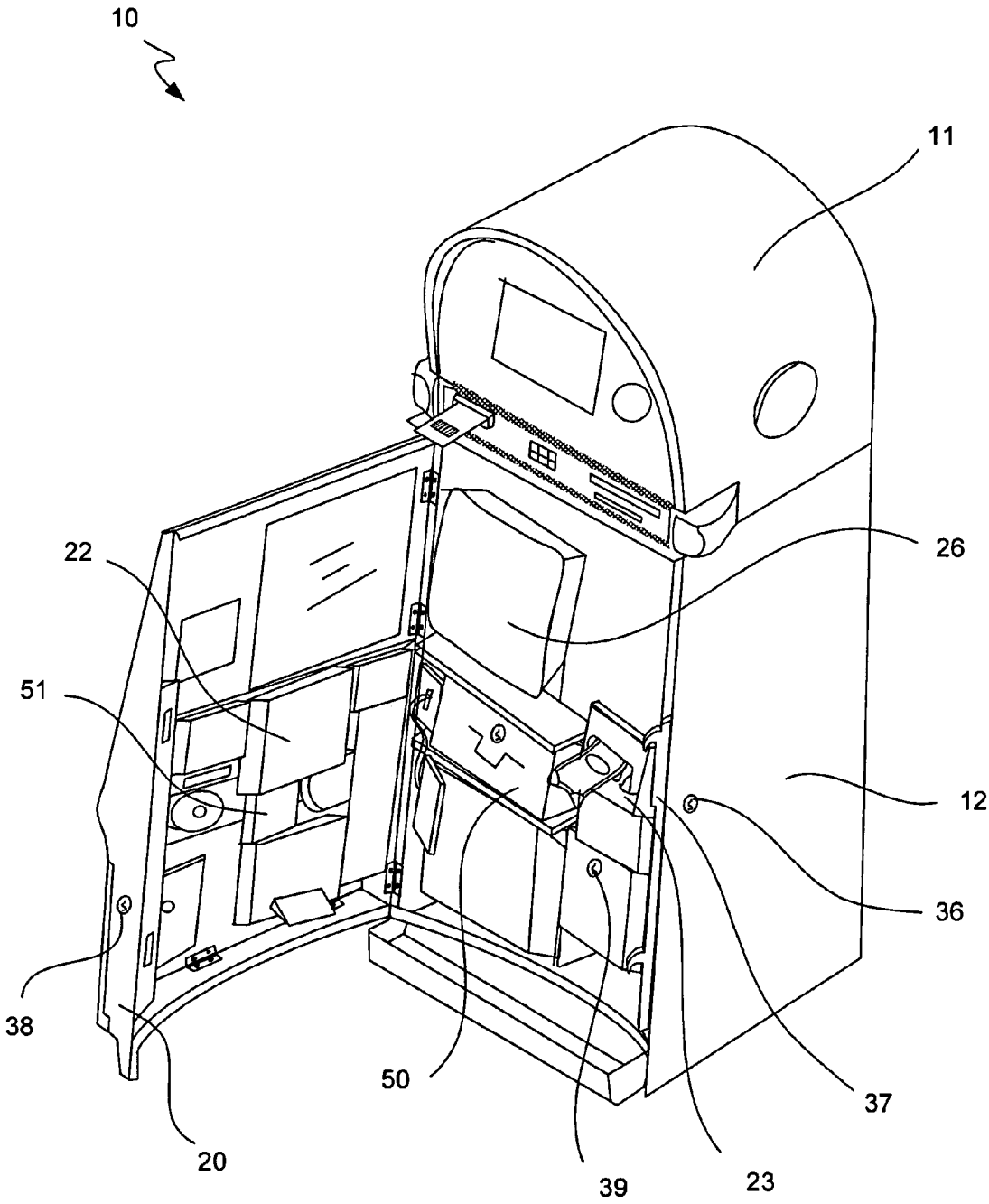
FIG. 1D illustrates in perspective view the gaming machine of FIG. 1C having an opened main door.

With reference to FIG. 1D, the gaming machine of FIG. 1C is illustrated in perspective view with its main door opened. In additional to the various exterior items described above, such as top box 11, main cabinet 12 and primary video display monitor 26, gaming machine 10 also comprises a variety of internal components. As will be readily understood by those skilled in the art, gaming machine 10 contains a variety of locks and mechanisms, such as main door lock 36 and latch 37. Other locks 38, 39 on various other machine components can also be seen. Internal portions of coin acceptor 22 and bill or ticket scanner 23 can also be seen, along with the physical meters associated with these peripheral devices. Processing system 50 includes computer architecture for performing credit device redemption and print confirmation, running a game on machine 10, and will be described below with respect to FIG. 5.

When a person wishes to play a gaming machine 10, he or she provides a printed credit device to a scanner included in the gaming machine that is configured to read information printed on the credit device. The scanner may comprise a bill scanner or a similar device configured to read printed information on a credit device such as a paper ticket or plastic card. In this case, the person inserts the ticket or card into a slot that receives the credit device. The credit device may be stored in the interior of the gaming machine. During interaction with the gaming machine, the person views game information using a video display. Usually, during the course of a game, a player is required to make a number of decisions that affect the outcome of the game. The player makes these choices using a set of player-input switches.

After the player has completed interaction with the gaming machine, the player may receive a portable credit device from the machine that includes any credit resulting from interaction with the gaming machine. By way of example, the portable credit device may be a ticket having a dollar value produced by a printer within the gaming machine. A record of the credit value of the device will be stored in a memory device provided on the network 100 (e.g., a memory device associated with CVT 106 and/or processing system 101). Any credit on the device may be used for further games on other gaming machines 10. Alternatively, the player may redeem the device at a designated change booth or pay machine.

Figure 2:
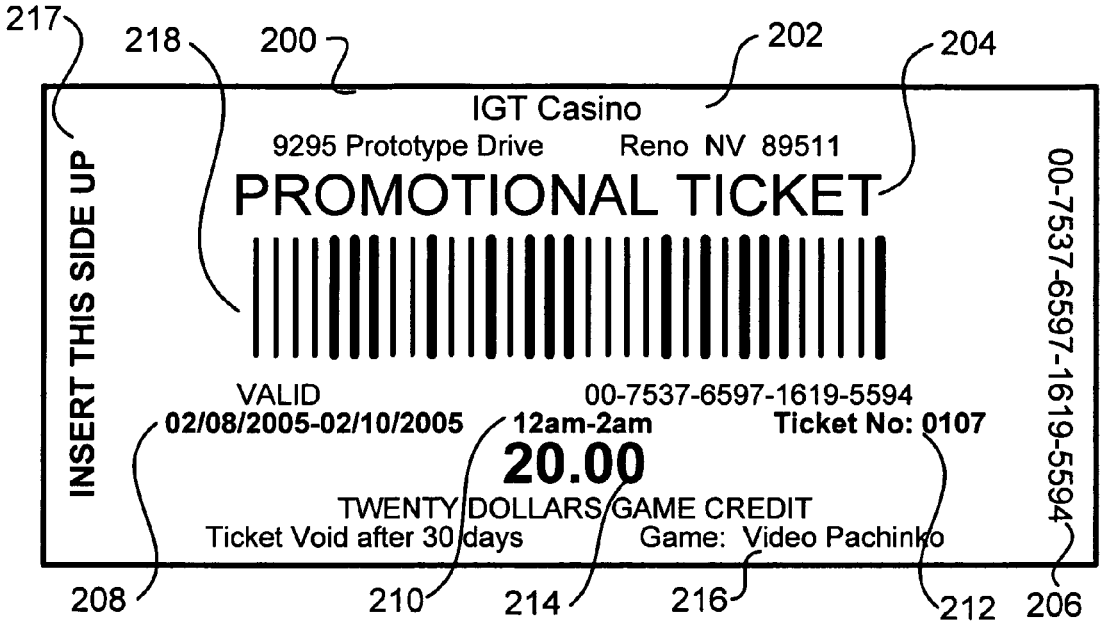
FIG. 2 illustrates an exemplary bar-coded ticket in accordance with one embodiment of the present invention.

Having discussed an exemplary gaming system suitable for use with of the present invention, printed credit devices suitable for use with the present invention will now be expanded upon. FIG. 2 illustrates a printed paper ticket 200 in accordance with a specific embodiment of the present invention. Ticket 200 includes printing on one side, the facing side.

Ticket 200 displays one or more gaming information elements. The gaming information elements may include a casino identification 202, a ticket identification 204, a ticket number 206, a conditional date range 208, a conditional time 210, a ticket number 212, a credit value 214, and a conditional game or machine requirement 216. Ticket 200 may also display other information to assist the player such as instructions 217.

Ticket number 206 is a unique number generated for ticket 200 such that each ticket 200 may be exclusively identified. As will be described in further detail below, ticket number 206 allows a gaming machine or processing system that communicates with the gaming machine to verify the print status of ticket 200. More specifically, after receiving ticket 200 in a gaming machine and optically reading the ticket number stored on ticket 200 using a scanner included in the gaming machine, the processing system checks if the printing services provider 2 has verified printing for ticket 200 according to ticket number 206. In one embodiment described in further detail below, the ticket number is used to access a database that stores a print status for each ticket that has been printed by an outsourced printing services provider 2.

Ticket 200 comprises multiple conditional usage requirements. As the term is used herein, a conditional usage requirement refers to a condition that must be met before any value or game credit is redeemed for ticket 200. A conditional usage requirement may be applied to ticket 200 to control usage of the ticket. Alternatively, as mentioned above, conditional usage requirements may be applied to protect a casino's intent for ticket usage. Exemplary ticket constraints may comprise a date range, a time of day, a particular type of game (e.g., Video Pachinko), a particular type of gaming machine, a particular gaming establishment such as a casino, a designated location of the gaming machine within the gaming establishment (as identified by a unique number for the gaming machine), a minimum wager or a wager range, etc. In general, a credit device for the present invention may comprise a conditional usage requirement that relates to any usage parameter related to interaction between a credit device and gaming machine and any business interest for a gaming establishment, e.g., to promote player interaction or customer base.

The gaming machine or gaming system (such as a network 100 that includes a gaming machine) includes a processing system configured to verify any conditional usage requirements placed on ticket 200. The processing system first checks if any conditional usage requirements have been placed on ticket 200, e.g., as stored in a database according to ticket number 206. In one embodiment described in further detail below, the ticket number is used to access a database that stores any conditional usage requirements for ticket 200 that has been printed by a printing services provider 2. If any conditions have been placed on ticket 200, the processing system verifies whether a print confirmation has been received and that all usage conditions are valid before redeeming any value or game credits on ticket 200.

Ticket 200 comprises three conditional usage requirements: a conditional date, a conditional time and a conditional game. Conditional date range 208 specifies what days ticket 200 will be redeemed for game credit. Conditional time 210 refers to a time range for which the ticket 200 will be redeemed in the valid days provided by conditional date range 208. Conditional time 210 allows a casino to print and provide tickets that promote activity in the casino during a certain time of day, such as hours in which the casino experiences statistically low activity. Conditional game or machine requirement 216 specifies a specific game that ticket 200 is redeemable with. Typically, one or more dedicated machines operate a specific game and requirement 216 allows a casino to specify both the game and/or dedicated machine(s) for which ticket 200 is applicable.

Ticket 200 also includes a bar-code 218. Bar-code 218 optically stores one or more of the gaming information elements listed above in a manner which is readable by an optical scanning device employed on a gaming machine 102. For example, bar-code 218 may include ticket number 206 for unique identification of ticket 200.

In a specific embodiment, ticket 200 may be a ticket used in the EZPay ticket system. The EZPay ticket system is fully described in commonly owned U.S. Pat. No. 6,682,421 entitled "Wireless Gaming Environment", which is incorporated herein by reference in its entirety for all purposes.

Figure 3:
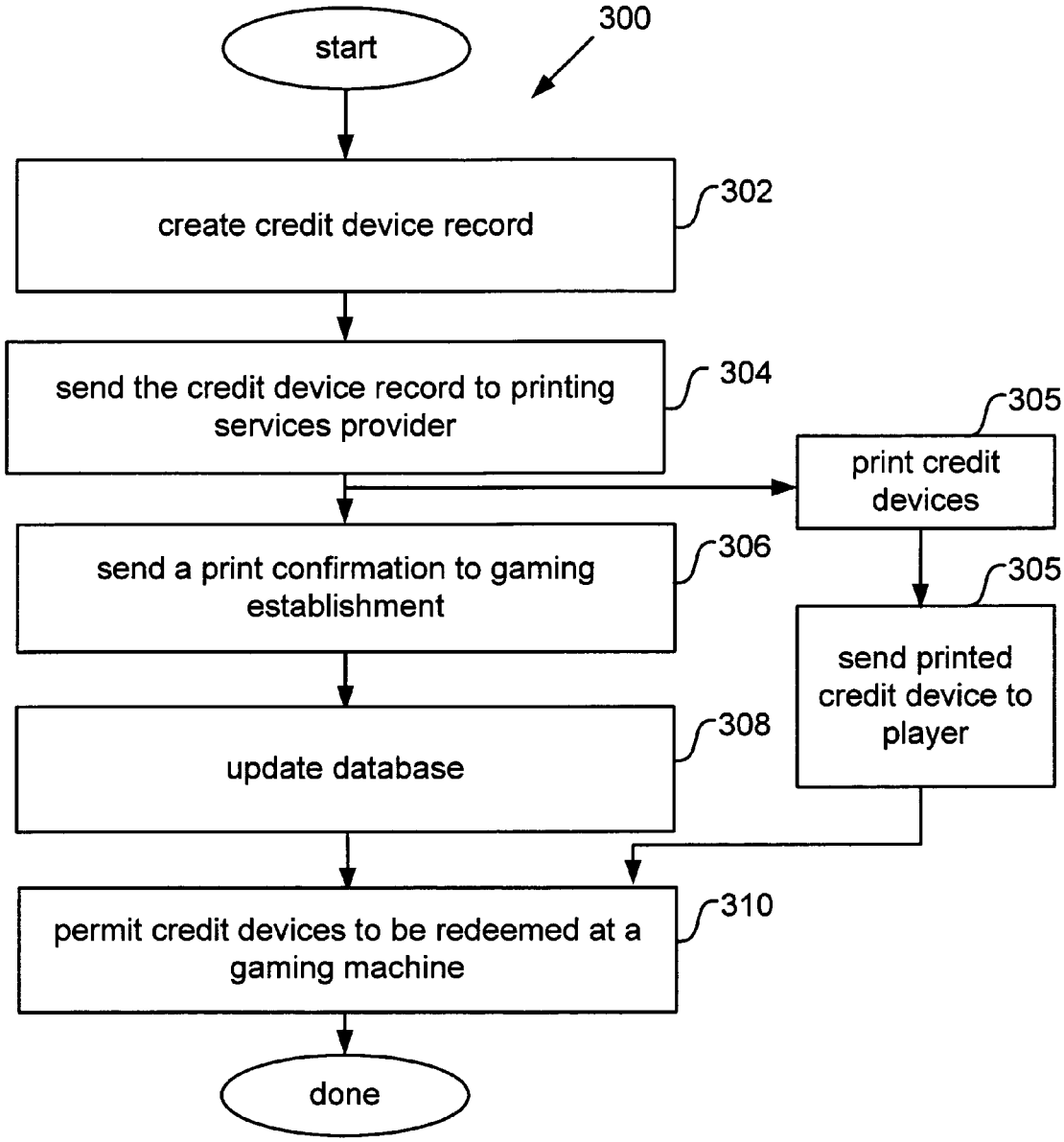
FIG. 3 illustrates a process flow for providing a printed credit device service for players of a gaming machine accordance with one embodiment of the present invention.

FIG. 3 illustrates a process flow 300 for providing a printed credit device service for players of a gaming machine in accordance with one embodiment of the present invention. Processes in accordance with the present invention may include up to several additional steps not described or illustrated here in order not to obscure the present invention.

Process flow 300 includes communication between a gaming establishment and a printing services provider, such as a dedicated printing house. Since promotional credit device includes information such as ticket numbers, ticket values and other private credit device information that should not be readily visible or tampered with, a secure file exchange mechanism is implemented between the gaming establishment and printing services provider.

In one embodiment, a publicly available encryption and authentication technique is employed. In a specific embodiment, secure ticket files are created using a commercially available compression utility that provides integration of advanced encryption algorithms and authentication schemes using digital certificates. Public-key encryption uses a combination of a private key that is known only to a single computer and a public-key that is given (by the computer) to any other computer that wants to communicate securely with the computer. A sending computer encrypts a document (such as an XML file) using the recipient's public-key and its own private key. The receiving computer uses the public-key (as provided by the other computer) and its own private key to decode the encrypted message. The compressed files may also be authenticated using digital signatures or digital certificates created via the 'sender's private key'. The digital certificates permit each recipient to confirm identity of the sender.

In general, the present invention may employ any process of encoding and protecting information in such a way that only the person (or computer) designated as receiver can decode it. Commercially available and well-known public/private key encryption systems are well suited for use with the present invention to protect secure files transmitted between a gaming establishment and printing services provider. In this case, the gaming establishment may include a communications computer dedicated to communicating with a computer controlled by printing services provider. The communications computer may include software installed thereon that comprises: a) the printing service provider's public-key digital certificate, b) a digital certificate (with the public/private key pair) for the gaming establishment and c) any Certificate Authority certificates. The computer controlled by the printing services provider may include software installed thereon that comprises: a) the printing house's digital certificate (with the public/private key pair), b) the casino's public-key digital certificate, and c) any Certificate Authority certificates if used. The appropriate trusted third party Certificate Authority signs digital certificates.

Process flow 300 begins by creating a credit device record (302). The credit device record contains a designation for all credit devices to be printed at the printing services provider. The record is typically electronic (or digital) and may embodied in a commercially available file format such as XML. The file may comprise unique numbers for each credit device to be printed, credit value for each credit device on a gaming machine, user names, a conditional usage requirement, as well as other user definable player data. Separate files may also be sent from the gaming establishment to the printing services provider that specify printing instructions. For example, separate files may designate when the credit devices are to be printed, what graphics are to be used, and indicate any conditional usage requirements.

The record may also include information related to the creation and usage of the credit devices. Such information may include mass promotional credit device information, promotional credit device batch context, player batch information, player credit device information, gaming machine system operational information such as information related to the EZPay system, and general credit device details. Mass promotional credit device information may comprise a site identification for the casino that honors the credit devices, a promotional identification such as a particular convention or tour related to the promotion, a promotional batch identification that uniquely identifies a printing batch for a set of credit devices, and a promotional credit device batch timestamp that indicates the date and time of creation for the credit device batch. Player credit device details may include a promotional credit device validation code that comprises an 18 digit number for the gaming system or network, a promotional ticket print date, a credit device sequence, credit device amount, the credit device text, credit device expiration date, credit device property name, a promotional credit device type text such as 'playable only', and a promotional credit device context for communicating with the printing services provider. General credit device details may include a promotional ticket validation code, a promotional credit device print date, a credit device sequence number, a credit device amount or redemption value, a credit device text, credit device expiration date, and a credit device property name, for example.

The record is then sent from the gaming establishment to the printing services provider (304). Sending a file via a network such as the internet typically employs some form of security. In a specific embodiment, the credit device record is compressed using a commercially available compression utility, and then encrypted using the recipient's public-key (e.g., printing service provider's public-key). A digital signature may also be created using the gaming establishment's private key. This permits e-mail to be the mode of transmission for sending the file from the gaming establishment to the printing house. Alternatively, the credit device record may be stored on a storable media such as a floppy disk, CD-ROM or USB memory device and transmitted manually from the gaming establishment to the printing services provider.

The printing services provider then receives and processes the credit device record. Receipt for a securely transmitted electronic file may include decryption and authentication that the file was received from the gaming establishment. For the specific embodiment given above, receipt may comprise verifying the digital signature using the gaming establishment's public-key, decryption using the printing service provider's private key, and file decompression after decryption and authentication.

The credit devices are then printed (305) by the printing services provider. Suitable printed credit devices and printing techniques were described above. Printing may rely on information included in the credit device record, such as the number of tickets to be printed and individual numbers for each ticket. The printed credit devices are also sent to the customer (307).

After printing, the printing services provider generates a print confirmation. Print confirmation may comprise a file or any other message format suitable for transmission to the gaming establishment. In a specific embodiment, the printing house generates a print confirmation XML file that lists each ticket number that was printed along with any relevant ticket information associated with each ticket number such as ticket value, redeemable dates, etc. Other information in the print confirmation may include a batch print confirmation number or root element for an XML file containing a response back from the printing services provider that confirms printing of the batch, a promotional credit device batch context, a printing house confirmation code that includes a control code returned by the printing services provider that uniquely identifies the batch printed from the perspective of the printing services provider, and various print confirmation details. Promotional credit device batch context information may include a site identification that uniquely identifies the gaming establishment or casino, a promotional identification or number that uniquely identifies the promotional circumstances surrounding the credit device, a promotional print description that describes the promotion and how it is to be printed on the ticket, a promotional batch identification that uniquely identifies this particular promotion among a pool of promotions offered by gaming establishment, and a promotional ticket batch timestamp that indicates the date and time of the creation of the promotional ticket batch (which may or may not be the file timestamp).

The printing services provider then sends the print confirmation to the gaming establishment (306). Confirmation may comprise any suitable handshake between a computer designated by the printing services provider and a processing system operated by the gaming establishment. In one embodiment, confirmation comprises an e-mail or simple electronic communication from the printing services provider that is received by the processing system that indicates printing confirmation. In another embodiment, confirmation comprises a print confirmation file created by the printing services provider. The file may list each credit device that has been printed.

Transmission of a secure print confirmation file may comprise compressing the file, encrypting the file using the recipient's public-key (e.g., a casino's public key), and attaching a digital signature created using the printing service provider's private key. This permits e-mail to be the mode of transmission for sending the print confirmation file from the printing house to the gaming establishment. Similar to above, the print confirmation file may be stored on a portable storable media and transmitted manually from the printing house to the gaming establishment.

Receiving a secure print confirmation file may include decryption and authentication as follows: verify the digital signature using the printing service provider's public-key, decryption using the recipient's or gaming establishment's private key, and decompression to obtain the file. Securing the file during transmission deters someone from unscrupulously, for example, from stealing the file during transmission and printing tickets unknowingly to the gaming establishment.

Upon receipt, the gaming establishment processes the print confirmation. In one embodiment, the gaming establishment include a receiving processing system that updates a database including entries for each credit device printed by the printing services provider (308). The update indicates print confirmation from the printing services provider for each credit device. More specifically, a database entry for each credit device may include a 'print status' field. After confirmation has been received, the print status field for each credit device printed by the printing services provider may be updated to designate that printing has occurred.

Since the print status may act as a disqualifying condition for redeeming the credit device at a gaming machine, updating each credit device in a database allows each device to be redeemed at a gaming machine when used by a person (310). In one embodiment, a preset time delay is automatically established between a time of printing at a printing service provider and when the credit device may be redeemed at a gaming machine.

Thus, when the credit device is redeemed at a gaming machine, the authenticity of the credit device is confirmed and its status in a database and related information is updated. The credit device may be presented or redeemed in a number of matters. For example, a person carrying the credit device may travel to a gaming machine that is arranged to accept the credit device and use the credit device to acquire any credit associated therewith to entitle the player to play game on the gaming machine. Verification by the gaming machine may include matching a number read from the credit device against a stored record for the credit device based on its number. Verification may determine whether the credit device has been authorized as printed. Verification may also determine whether the credit device has already been used and confirming file you on the credit device. Once redeemed, the voucher record in a database may be updated to reflect that the credit device has been paid and is no longer outstanding.

Process flow 300 may also be extended to the exchange of files containing sensitive gaming system information, such as player account cards and promotional cards, that are sent to third parties by a gaming establishment for embossing and printing. In addition, although the present invention has primarily been described with respect to tickets that can convey gaming credit on a gaming machine, the present invention may also be applied to number of different environments such as food service, entertainment shows, promotional game play, or events to where tickets, vouchers or the like may be issued and redeemed or used.

The print status for each credit device may be electronically stored. In one embodiment, an electronic record for each credit device comprises an entry in a database. The electronic record for each printed credit device may then be updated when the print confirmation has been received from the printing services provider. The database may be a) centralized to a gaming system, b) included in a gaming machine, and/or c) a database may included local to a CVT for a certain number of gaming machines. Any conventional database tool is suitable for use with the present invention. By way of example, a DBA or SQL database are both suitable for use with the present invention.

In some cases, the printing services provider is capable of generating credit devices without the need for a real-time connection with the gaming establishment. Thus a data link may be established at one or more particular times at which batches of information are transmitted back and forth. For example, a communication link may be established between the printing services provider and gaming establishment when a large number of credit devices is to be generated and electronic records for these credit devices are transmitted back and forth between the two entities in a short period of time. The communication link may be established for such purpose of various time intervals, or upon the occurrence of other events, such as the generation of a predetermined number of credit devices.

FIG. 4 presents a logical representation of a database 500 for storing a large number of credit devices with a print status in accordance with a specific embodiment of this invention. Database 500 includes a number of records 501, each relating to an individual credit device. Each record 501 may also be referred to as an entry for database 500. A primary key 502 uniquely identifies each record 501. A ticket number for each credit device may also be used uniquely identify each record 501. Each record 501 comprises a number of fields 504-512.

A print status field 504 indicates whether a print confirmation has been received for a particular record 501. The print confirmation indicates whether a printing services provider has confirmed printing of the credit device. In a specific embodiment, two options may be included in the print status field 504: 'received' and 'not-received'. A flag may also be used, where absence of the flag indicates that a print confirmation has not been received from the printing services provider for a particular record 501.

Value field 506 indicates the redemption value of each credit device. In one embodiment, the value comprises game credit on a gaming machine. A redemption status field 508 indicates whether the credit device has yet to be redeemed at a gaming machine. In some cases, database 500 may record unsuccessful attempts to use the credit device. For example, an unsuccessful attempt may include an attempt to use a credit device before a printing services provider sends a print confirmation. Alternatively, the redemption status room an unsuccessful attempt may include an attempt to use the credit device that fails a conditional usage requirement.

Each credit device and record 501 may also include a number of conditional usage requirements. Database 500 includes fields for two conditional usage requirements: a required date field 510 and a gaming machine number field 512. Two records 501 may include a date for which the credit device must be redeemed at a gaming machine. Three records include a machine number range that specifies which gaming machines in a gaming establishment that the credit device must be redeemed at. Typically, gaming machines in a gaming network are each assigned a unique number. Specifying which gaming machines the credit device must be redeemed at allows a gaming establishment to control one or more of: 1) a location in a gaming establishment where the credit device may be redeemed (by specifying gaming machines in a particular location), and/or 2) a specific game played on one or more gaming machines (e.g., video Pachinko).

The present invention employs some form of processing system that is configured to a) verify that a confirmation has been received from the external printing services provider and b) permit value on the printed credit device to be redeemed at the gaming machine after the confirmation has been received.

Figure 5:
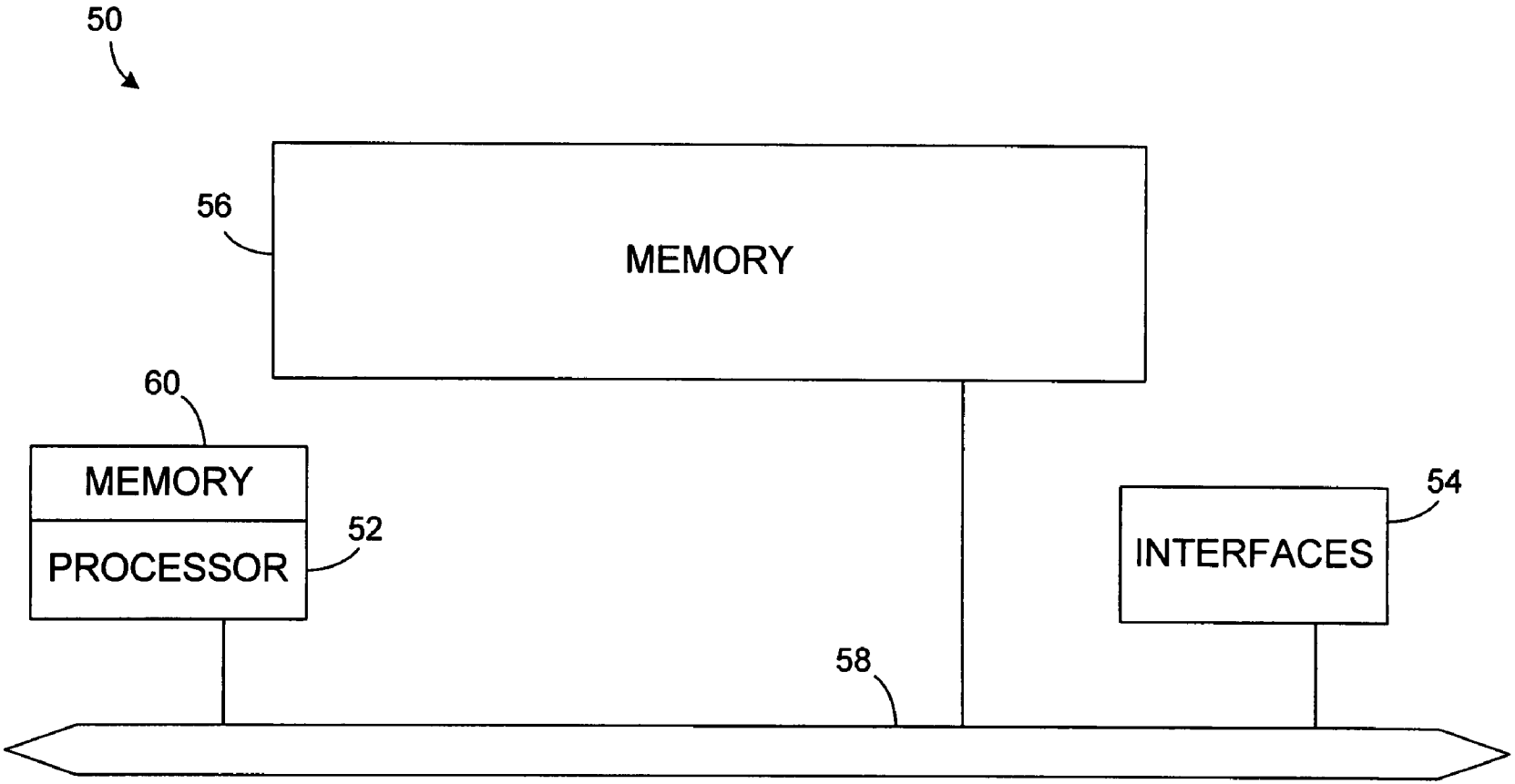
FIG. 5 illustrates an exemplary processing system in accordance with one embodiment of the present invention.

Referring now to FIG. 5, a simplified processing system 50 is shown in accordance with one embodiment of the present invention. System 50 includes a general architecture for performing credit device redemption and print confirmation. In one embodiment, processing system 50 is included in a gaming machine. In another embodiment, the gaming machine operates in a network and processing system 50 is included in a computer or central controller that operates on the network. For the network 100 of FIG. 1B, processing system 50 may be included in information services 108 or in a Clerk Validation Terminal (CVT) 106. In this case, the gaming machine communicates with processing system 50 across network 100 according to its location in the network.

Processing system 50 comprises a processor (or CPU) 52, interfaces 54, memory 56, and a bus 58 (e.g., a PCI bus). When acting under the control of appropriate software or firmware, processor 52 redeems value on a credit device produced at a gaming machine by verifying that a confirmation has been received from the external printing services provider for the credit device. CPU 52 may include one or more processors such as a processor from the Motorola family of microprocessors or the MIPS family of microprocessors. In an alternative embodiment, processor 52 is specially designed hardware for controlling the operations of a gaming machine. In one embodiment, a memory 60 (such as non-volatile RAM and/or ROM) also forms part of CPU 52. However, there are many different ways in which memory could be coupled to the processing system.

Interfaces 54 control the sending and receiving of data packets over a network in communication with system 50 and may support other peripherals used with system 50. Among the interfaces that may be provided are Ethernet interfaces, cable interfaces, wireless interfaces, and the like. In addition, various very high-speed interfaces may be provided such as fast Ethernet interfaces, Gigabit Ethernet interfaces, ATM interfaces and the like. Generally, these interfaces may include ports appropriate for communication with the appropriate media. In some cases, they may also include an independent processor and, in some instances, volatile RAM. The independent processors may control such communications intensive tasks as packet switching, media control and management.

Although the system shown in FIG. 5 is one specific processing system, it is by no means the only processing system architecture on which the present invention can be implemented. For example, an architecture having a single processor that handles credit device redemption as well as database management and updating, etc. would also be acceptable.

Regardless of network device's configuration (for cable plants or otherwise), it may employ one or more memories or memory modules (e.g., memory 56) configured to store program instructions for gaming machine network operations and other functions of the present invention described herein. Such memory or memories may also be configured to store data streams, data structures (such as the database described above with respect to FIG. 4), or other specific non-program information described herein.

Because such information and program instructions may be employed to implement the systems/methods described herein, the present invention relates to machine readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). The invention may also be embodied in a carrier wave travelling over an appropriate medium such as airwaves, optical lines, electric lines, etc. Examples of program instructions include both machine code, such as produced by a compiler, and files containing higher level code that may be executed by the computer using an interpreter.

Although the foregoing invention has been described in some detail for purposes of clarity of understanding, it will be apparent that certain changes and modifications may be practiced within the scope of the appended claims. For instance, while the methods and systems of this invention have been described primarily in reference to the gaming machine network, the present invention is well-suited for use on a single gaming machine, whether or not that gaming machine communicates regularly with a network or centralized control. Therefore, the present examples are to be considered as illustrative and not restrictive, and the invention is not to be limited to the details given herein, but may be modified within the scope of the appended claims.

What is claimed is:

1. A gaming system that redeems a printed credit device printed by a printing service provider for a predetermined face value redeemable for credit for play at a gaming machine in a gaming system, the printed credit device comprising information thereon that relates to a conditional usage requirement for use of the printed credit device within the gaming system, the gaming system comprising:

at least one gaming machine that includes an external cabinet defining an interior region of the gaming machine, the external cabinet adapted to house a plurality of gaming machine components, a display device adapted to display game play information, the display device being located within or about the external cabinet, and a scanner configured to read information from the printed credit device when the printed credit device is provided to the scanner, the scanner being located within or about the external cabinet;

a host that comprises a processing system configured to a) store information regarding the printed credit device, b) verify the identity of the of the printing services provider and that a confirmation has been received from the printing services provider confirming that said provider printed the printed credit device and that the credit device is authorized as printed, c) verify whether the conditional usage requirement on the printed credit device is fulfilled; and d) permit value on the printed credit device to be redeemed at the gaming machine after the print confirmation has been received and the fulfillment of the conditional usage requirement has been verified; and a communication link permitting information to be transmitted between the at least one gaming machine and the host.

2. The gaming system of claim 1 wherein the external printing services provider is geographically remote from a gaming establishment that owns the gaming system.

3. The gaming system of claim 1 wherein the host is included in a central controller for the gaming system.

4. The gaming system of claim 1 wherein the printed credit device comprises a paper ticket or a plastic card that was printed by the printing services provider.

5. The gaming system of claim 4 wherein the scanner comprises an optical scanner configured to read information from a known position on the printed credit device.

6. The gaming system of claim 1 wherein the printed credit device has no monetary value independent of the game credits.

7. The gaming system of claim 1 wherein the conditional usage requirement comprises one of: a time of day for the printed credit device to be used, a date range for the printed credit device to be used, a game type provided by the game machine, and a machine location for the game machine.

8. The gaming system of claim 1 wherein the conditional usage requirement is stored in a bar-code printed on the printed credit device by the external printing services provider.

9. The gaming system of claim 1 wherein the host further comprises a network interface that allows the host to communicate with the printing services provider.

10. The gaming machine of claim 1 wherein the gaming machine further comprises a network interface that allows the gaming machine to communicate with the printing services provider.

11. A gaming machine that redeems a printed credit device printed by a printing service provider for a predetermined face value redeemable for credit for play at a gaming machine in a gaming system, the printed credit device comprising information printed thereon that relates to a conditional usage requirement for use of the printed credit device on the gaming machine that was printed by a printing services provider, the gaming machine comprising:

an external cabinet defining an interior region of the gaming machine, the external cabinet adapted to house a plurality of gaming machine components within or about the interior region;

a display device adapted to display game play information, the display device being located within or about the external cabinet;

a scanner configured to read information from the credit device when the printed credit device is provided to the scanner, the scanner being located within or about the external cabinet;

a processing system configured to a) store information regarding the printed credit device, b) verify the identity of the printing services provider and that a confirmation has been received from the printing services provider confirming that said provider printed the printed credit device and that the credit device is authorized as printed; c) verify whether the conditional usage requirement on the printed credit device is fulfilled; and d) permit value on the printed credit device to be redeemed at the gaming machine after the confirmation has been received and the fulfillment of the conditional usage requirement has been verified; and a network interface that allows the gaming machine to communicate with the printing services provider.

12. The gaming machine of claim 11 wherein the external printing services provider is geographically remote from a gaming establishment that owns the gaming machine.

13. The gaming machine of claim 11 wherein the printed credit device comprises a paper ticket or a plastic card that was printed by the printing services provider.

14. The gaming machine of claim 13 wherein the scanner comprises an optical scanner configured to read information from a known position on the printed credit device.

15. The gaming machine of claim 11 wherein the printed credit device has no monetary value independent of the game credits.

16. The gaming machine of claim 11 wherein the conditional usage requirement comprises one of: a time of day for the printed credit device to be used, a date range for the printed credit device to be used, a game type provided by the game machine, and a machine location for the game machine.

17. The gaming machine of claim 11 wherein the conditional usage requirement is stored in a bar-code printed on the printed credit device by the external printing services provider.

18. A method for providing a printed credit device service for players of a gaming machine, said service providing printed credit devices having a predetermined face value redeemable for credit for play at a gaming machine in a gaming system, the method comprising:

creating a credit device record that comprises a list of credit devices to be printed;

sending the credit device record to a printing services provider;

authenticating identity of a sender of the credit device record, receiving authentication of the identity of the printing services provider and a confirmation from the printing services provider that indicates that the credit devices have been printed by said printing services provider and that the credit devices are authorized as printed;

updating an electronic record for each credit device to note that the print confirmation has been received; and redeeming value on a printed credit device included in the list of credit devices at a gaming machine for game credit for play after verifying that the confirmation has been received for the printed credit device and verifying fulfillment of a conditional usage requirement for use of the printed credit device on the gaming machine.

19. The method of claim 18 further comprising securing the credit device record.

20. The method of claim 18 wherein the confirmation comprises a print confirmation record that includes a number for each credit device that was printed.

21. The method of claim 20 further comprising securing the print confirmation record.

22. The method of claim 18 further comprising transmitting information from the gaming machine to a host regarding an identity of the credit device.

23. The method of claim 22 wherein the host stores the electronic record for the credit device.

24. The method of claim 18 wherein creating a credit device record comprises generating data regarding the list of credit devices to be printed, the data including a value representative of a number of credits usable at a gaming machine for each credit device.

25. The method of claim 18 wherein the electronic record for each credit device comprises an entry in a database.

26. The method of claim 18 wherein the conditional usage requirement is printed on the printed credit device.

27. The method of claim 18 wherein the conditional usage requirement comprises one of: a time of day for the printed credit device to be used, a date range for the printed credit device to be used, a game type provided by the gaming machine, identity of the gaming establishment that operates the gaming machine, and a machine identity for the gaming machine.

* * * * *